US005482293A

United States Patent [19]

Lekavich

[11] Patent Number: 5,482,293

[45] Date of Patent: Jan. 9, 1996

[54] ARROWHEAD

[76] Inventor: Carl W. Lekavich, 21529 Menlo Ave., Torrance, Calif. 90502

[21] Appl. No.: 223,831

[22] Filed: Apr. 6, 1994

Related U.S. Application Data

[63] Continuation of Ser. No. 711,167, Jun. 5, 1991, abandoned.

[51] Int. Cl.[6] ..... F42B 6/08

[52] U.S. Cl. ..... 273/422

[58] Field of Search ..... 273/416, 419–423

[56] References Cited

U.S. PATENT DOCUMENTS

| | | | |
|---|---|---|---|
| 213,083 | 3/1879 | Wright et al. | 273/420 X |
| D. 310,553 | 9/1990 | Kania et al. | D 22/115 |
| D. 314,416 | 2/1991 | Rezmer | D 22/115 |
| 2,940,758 | 6/1960 | Richter | 273/422 |
| 3,398,960 | 8/1968 | Carroll, Jr. | 273/422 |
| 3,756,600 | 9/1973 | Maleski | 273/422 |
| 4,050,696 | 9/1977 | Troncoso, Jr. | 273/420 |
| 4,410,184 | 10/1983 | Anderson | 273/422 |
| 4,529,208 | 7/1985 | Simo | 273/422 |
| 4,533,146 | 8/1985 | Schaar | 273/422 |
| 4,537,404 | 8/1985 | Castellano et al. | 273/422 |
| 4,558,868 | 12/1985 | Musacchia | 273/422 |
| 4,616,835 | 10/1986 | Trotter | 273/421 |
| 4,874,180 | 10/1989 | Fingerson | 273/416 |
| 4,944,520 | 7/1990 | Fingerson et al. | 273/419 |
| 5,090,709 | 2/1992 | Johnson | 273/422 |

OTHER PUBLICATIONS

Bow & Arrow Hunting, Aug. 1986 Jun. 1986 p. 35 Muzzy Products Corp. Ad.

Bow & Arrow Hunting, Aug. 1987 Jun. 1987 p. 11 Muzzy Products Corp. Ad.

Bow & Arrow Hunting, Jun. 1990 Feb. 1990 Cover.

Bow & Arrow Hunting, Aug. 1990 May 1990 p. 18 Turbo SS Ad.

Bow & Arrow Hunting, Oct. 1990, Aug. 1990 Cover, p. 3.

Bow & Arrow Hunting, Aug. 1991, May 1991 Cover.

*Primary Examiner*—Paul E. Shapiro

*Attorney, Agent, or Firm*—Richard C. Litman

[57] ABSTRACT

A high penetration arrowhead with an adjustable alignment and weight screws onto the end of a hollow arrow shaft. The arrowhead has a hollow ferrule covered by a grooved resin sleeve. A point at the forward end of the ferrule presents an interior inclined surface at the forward end of each groove. A blade with an inclined cutting edge fits into each groove so that the cutting edge contacts the inclined surface pressing the blade into the bottom of the groove. A retaining ring at the rear end of the groove encircles tabs on the blades and drives the blades forward to hold the blades in place as the arrowhead is screwed onto the shaft. Deformable lands on the groove bottom allow the arrowhead's adjustable alignment to be adjusted while maintaining pressure on the blades. The point has a secondary facet directly in front of each cutting edge to enhance penetration and the ferrule has a narrowing cross section behind the point for the same reason. A weight rod fits inside the hollow ferrule and seats against the point. The weight rod is scored so that pieces can be broken off to adjust its weight. The point also has a seat for the structural tube to be pressed into so on impact the tube cannot spread thus creating all forces to be dispersed equally throughout the arrow shaft.

16 Claims, 3 Drawing Sheets

ARROWHEAD

CROSS-REFERENCE TO RELATED APPLICATION

This is a continuation of application of application Ser. No. 07/711,167 filed Jun. 5, 1991, now abandoned.

FIELD OF THE INVENTION

The present invention pertains to the field of arrowheads for use with arrow shafts, and in particular to a high-penetration, high velocity arrowhead with self alignment capabilities and weight adjustability for front to rear arrow balance.

BACKGROUND OF THE INVENTION

Current arrowheads are fraught with limitations which become particularly acute when the arrowheads are used for hunting. Broadheads, usually preferred for hunting arrows, typically vary in weight and may not necessarily balance any particular arrow shaft. As a result the arrow shaft does not properly track, or follow the head in flight. A broadhead typically has a set of blades which extend outward from the ferrule of the arrowhead and render an arrow difficult to draw past the riser because the blades interfere with the bow's riser unless the arrowhead is properly aligned. Once the arrow has been shot, its penetration into its target is limited by the excess size of the ferrule, improper blade angle, and the difficult transition from the broadhead point to the blades.

SUMMARY OF THE INVENTION

The present invention allows the weight of the arrowhead to be precisely adjusted to ensure that the shaft properly tracks, follows the head for maximum accuracy, arrow flight and range. The arrowhead, once mounted to the shaft, can be rotated with respect to the riser to obtain perfect alignment with the bow riser. The ferrule has a reduced cross section past the broadhead point to reduce ferrule drag when entering the target. The blades are set at precisely the right angle of entry for maximum penetration of the target, and the leading edges of each blade are preceded by a primary leading edge on the arrowhead point which serves to ease the entry of the blade cutting edge into the target. The secondary facet assures the penetrating surface to be taut for maximum penetration.

BRIEF DESCRIPTION OF THE DRAWINGS

These and other aspects of the invention will be more fully understood by referring to the following detailed description and the accompanying drawings, wherein.

DETAILED DESCRIPTION OF THE INVENTION

The present invention relates primarily to a broadhead arrowhead for use in hunting. However, many of the advances of the present invention can be incorporated into other kinds of arrows for target shooting and the like. While it is presently preferred that the present invention be incorporated into a broadhead, many aspects of the invention may also be used in other types of arrowheads, regardless of the use of the arrowhead.

Figure 1:
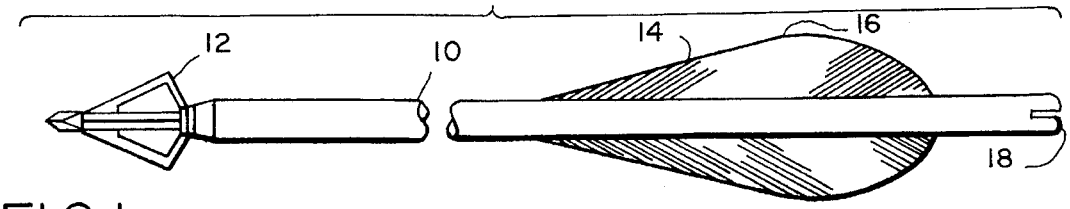
FIG. 1 is a side elevation view of an arrow incorporating an arrowhead constructed according to the present invention.

A typical arrow has a long shaft 10 (shown broken in FIG. 1) with an arrowhead 12 at one end and arrow tail 14 at the other. The tail has a set of feathers 16 and a nock 18 at its end. The nock is adapted to engage a bow string when the arrow is shot in a bow. For typical broadhead arrows, the arrowhead can be unscrewed from the shaft 10.

Figure 2:
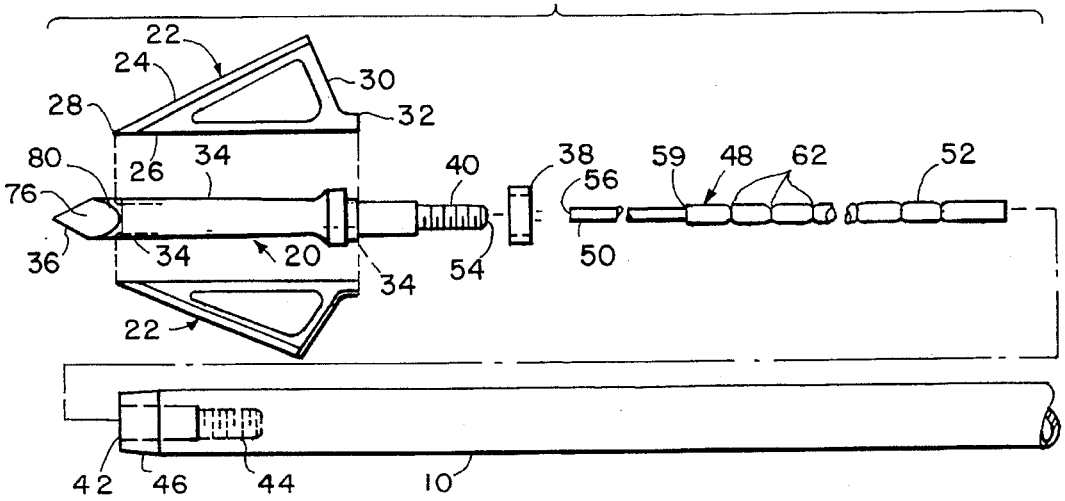
FIG. 2 is an exploded view of the arrowhead and a portion of the shaft of FIG. 1.

Referring to FIG. 2, a broadhead constructed according to the present invention has an elongated ferrule 20 to which a set of blades 22 is connected. The blades have a cutting edge 24 and a mounting edge 26. The cutting and mounting edges meet at a junction 28, and the cutting edge then diverges away from the mounting edge at an angle. The cutting edge ends at a perpendicular support 30 which also connects to the mounting edge. At the junction between the mounting edge and the perpendicular support is a retaining tab 32. Each blade, including the tab 32, fits into a groove 34 in the ferrule. At the front end of the ferrule is a point 36, and the groove preferably extends from the point back to a location near the rear end of the ferrule. A retaining ring 38 slides over the rear end of the ferrule, and encircles the tabs 32 of all of the blades to hold the rear ends of the blades in place. The front ends of the blades at the junction 28 are held in place by the point as described below.

The rear end of the ferrule has a male threaded connection 40 which is inserted into a central bore 42 in the arrow shaft (the insert is glued into the end of the hollow arrow shaft). Inside the bore is a female threaded connection 44 which the male threaded connection on the arrowhead screws into. A flange 46 at the opening of the arrow shaft bore contacts the retaining ring 38 so that when the arrowhead is screwed into the arrow shaft, the flange butts up against the retaining ring and holds the retaining ring in place against the perpendicular supports of the blades.

Figure 3:
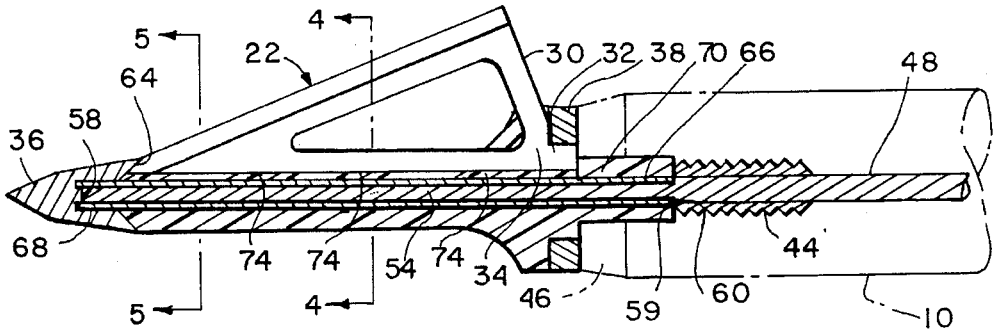
FIG. 3 is a cross-sectional view of the arrowhead and a portion of the shaft of FIG. 1.

In addition, a weight rod 48 is provided. The weight rod has a retaining end 50 and a weight end 52. The retaining end is inserted into an axial bore 54 through the center of the ferrule, as best seen in FIG. 3. At the end of the retaining end of the rod is a seat 56 which seats against a seat 58 at the end of the ferrule bore. In addition, a shoulder 59 midway along the weight rod seats against a shoulder 60 in the ferrule bore near the ferrule's male threaded connection. The weight rod is inserted into the ferrule simply by pushing it into the ferrule bore. Pressure applied to the weight end of the weight rod, toward the seat and shoulder, wedges the rod into place. The tolerances between the weight rod and the ferrule bore are preferably close enough that the weight rod can be wedged into place and will stay there reliably during use. However, for greater security, a small amount of adhesive can be applied to the end of the weight rod to glue it onto its seat. When installed the weight end of the weight rod extends in the opposite direction out of the ferrule bore, into the axial bore 42 in the arrow shaft, see, e.g., FIG. 3.

Since arrow shafts are typically hollow throughout their entire length, the weight rod can be quite long. For a typical 80 cm long arrow with a 6.5 cm broadhead measured from the point to the end of the threads, it is presently preferred that the weight rod measure approximately 15 cm long. The weight rod is preferably cylindrical, with a set of coined grooves 62 on its weight end dividing the weight end of the rod into scored increments. The weight of the rod can be adjusted by breaking off portions of the weight rod at the grooves. Since the weight rod can be quite long, the range of adjustment can be quite great.

In use, the broadhead is assembled with the weight rod onto the end of the arrow shaft, and the arrow is then shot at a target. For maximum range, speed and accuracy, it is preferred that the arrow shaft track, i.e., follow the path of the arrowhead in flight. This is usually achieved when the arrow has a 60% to 40% front to rear weight balance. However, the precise weight distribution depends on the type of arrow shaft, and the relative weights of the shaft, feathers and nock. The weight rod is preferably initially too heavy for all commonly available arrow shafts. Therefore, after a first test flight, the excess heaviness of the arrowhead can be judged. The tester first observes the flight attitude of the arrow in a test flight and then breaks off one or more of the increments of the weight rod and retests the arrow by again shooting it toward a target for another test flight. If the arrowhead is still too heavy, then more increments of the weight rod are broken off. After perfect balance has been achieved, the arrow shaft-arrowhead combination is ready for actual use.

For use with typical hunting shafts, it is presently preferred that the arrowhead without the weight rod weigh approximately 82 grain, and that each increment on the weight rod weigh approximately 3 grain. The weight rod is preferably constructed of 316 full hard stainless steel with a diameter of about 2.3 mm so that each increment is about 6.3 mm long. The weight rod can be used with a variety of different types of arrowheads other than the broadhead shown in the drawings. In addition, the weight rod can be attached permanently to, or formed integrally with, the ferrule. It is presently preferred that the weight rod extend all the way into the ferrule and seat against a seat which is as close to the point as possible. This helps to transfer the weight of the weight rod upon impact directly to the point where it is most needed. It is also preferred that the weight rod be removable so that if too many increments are broken off in an attempt to adjust the weight of the weight rod, the weight rod can be replaced with a longer weight rod without discarding the ferrule.

Referring to FIG. 3, the ferrule has a preferably rigid 304 full hard stainless steel core 66 with a 258,000 psi tensile strength. Making the core hollow reduces its weight and allows the weight-adjusting rod to be seated at the point. Preferably, the point is metal injection molded of 440C stainless steel and has annular seat built directly into its core that is directly press fitted onto the forward end 68 of the hollow ferrule core and has an interior 45° incline surface 64 which allows the leading edge of the blades to back into when the blades are in place and the head is tightened. The stainless steel core is then surrounded with a deformable thermoplastic polycarbonate resin sleeve 70, for example, the resin sold under the trademark Lexan. This sleeve is injection molded over the core.

While the core has a cylindrical exterior, the sleeve provides the grooves 34 which hold the blades. The grooves are molded into the outer surface of sleeve and extend along its axis from the interior surface 64 of the point to the flange 46 at the end of the arrow shaft. When the blades 22 are placed into the grooves 34, the front tip of the blade cutting edge, where it joins the mounting edge, meets the inclined surface 64 on the interior edge of the point. When the arrowhead is screwed onto the arrow shaft this inclined surface forces the cutting edge of the blade downward as the blade is pushed forward in the groove by the arrow shaft flange 46.

Figure 4:
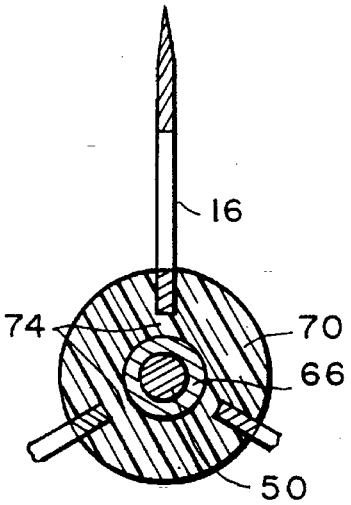
FIG. 4 is a cross-sectional view of the arrowhead of FIG. 3 taken along line 4—4.
Figure 5:
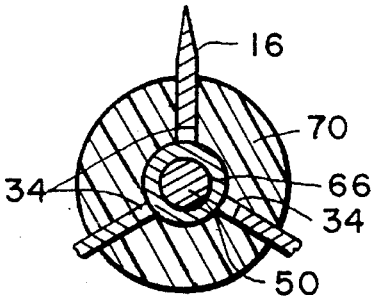
FIG. 5 is a cross-sectional view of the arrowhead of FIG. 3 taken along line 5—5.
Figure 6:
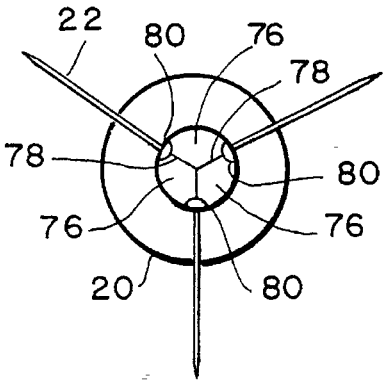
FIG. 6 is a front elevational view of the arrowhead of FIG. 1.
Figure 7:
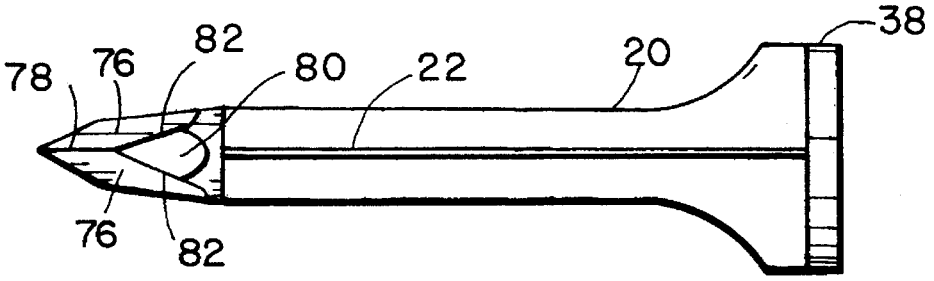
FIG. 7 is a side elevation view of the front portion of the arrowhead of FIG. 1 with a side blade taken directly above a secondary facet of the point.

The mounting edge of the blades rests against a set of spaced apart lands 74 at the bottom of the grooves in the sleeve. FIG. 4 shows the mounting edge of a blade resting on a land, while FIG. 5 shows the mounting edge suspended over a space between lands. The lands hold the mounting edge up away from the stainless steel core. The tabs 32 on the blades extend underneath the retaining ring 38. After the blades are inserted into the grooves and the retaining ring is slipped around the rear end of the ferrule and the tabs, the ferrule can be screwed on to the end of the shaft. As the ferrule is rotated into the arrow shaft threads, the retaining ring 38 butts against the flange 46 at the end of the arrow shaft. At some point, the core is screwed sufficiently far into the insert of the arrow shaft that the retaining ring holds the blade ends wedged against the interior surface and prevents the blades from wobbling or vibrating significantly in flight or from becoming removed upon impact with a target.

However, to obtain a full draw when shooting the arrow, the blades must be properly aligned with the nock at the opposite end of the arrow shaft. Typically, the nock is not adjustable and determines the position of the arrow shaft in the bow because of its connection with the bow string. If the blades are not properly aligned with the nock, then upon a full draw, the blades will interfere with the riser of the bow, preventing the arrow from being able to be drawn all the way on the arrow rest. Either the draw must be reduced to keep the blades away from the riser, or the blades must be realigned. In the present invention, since the ferrule sleeve is made from a deformable material, the arrowhead can be rotated beyond the point of initial tightness. As the arrowhead is further screwed into the arrow shaft to align the blades, the point is driven further toward the arrow shaft flange 46. The blades, held by the retaining ring, are then wedged further downward by the inclined surface on the point, compressing the lands on the ferrule sleeve. Thus, these lands provide the "give" to permit the broadhead to be rotated relative to the nock while the parts of the broadhead remain firmly held together. Because of the spaces between the lands, the lands deform and expand into the spaces under pressure. The spaces between lands can extend through the entire depth of the sleeve to the core, as shown in the drawings, or only part of that depth so that there is some sleeve material between lands. Using the stainless steel and Lexan construction described above and a conventional thread pitch, the arrowhead can be rotated a full turn beyond the point of initial tightness. This allows the blades easily to be aligned with the notch for a full draw of the bow string when shooting.

The blades are preferably also constructed of 440C stainless steel for a durable, easy-to-clean, hard edge. The point, as best seen in FIGS. 4 and 5, has a six-faceted design, the facets of which are precisely aligned with the leading edges of the blade cutting edges. In the preferred three-blade embodiment shown in the drawings, the point has a set of three primary facets 76 which initially meet the target.

Between each facet is a first set of leading edges 78. It is these facets which initially contact the target and create an opening in the target through which the arrowhead will penetrate. The three primary facets lead into a set of three secondary facets 80 which begin midway along the leading edge 78 between each of the three primary facets. The secondary facets are spaced apart rearward from the front tip of the point, and have leading edges 82 on either side. The secondary facets are aligned with the blades 22 so that the initial portion of the cutting edge of each blade is directly behind the center of a secondary facet. The leading edges 82 of the secondary facets spread the target material, holding it taut for the entry of the blade. This allows the blade to enter more smoothly and cleanly into the target for better penetration. Once the blade has smoothly entered the target, the cutting edge continues through into the target to its maximum penetration depth. Any number of first and secondary facets may be provided, preferably one of each per blade.

Figure 8:
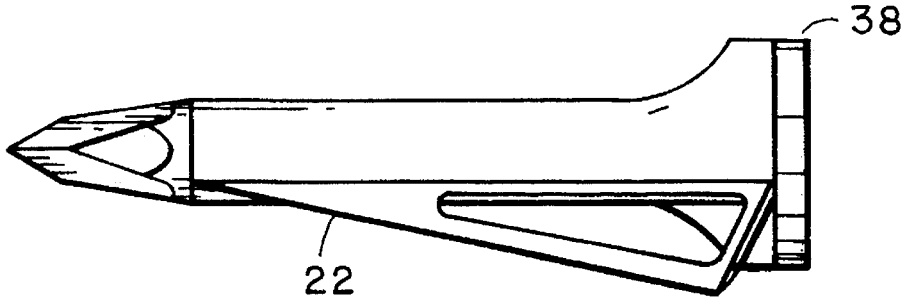
FIG. 8 is an alternative embodiment of an arrowhead constructed according to the present invention in a view similar to that of FIG. 7.

In some arrows, the feathers are designed to rotate the arrow in flight. Some of this rotational force still exists after the point impacts the target. In other words, the arrow continues to rotate even after the point has penetrated the target. As a result, in such arrows, the blade must be offset from the center of the secondary facet in order for the blade to enter between the two leading edges on either side of the secondary facet directly in front of it. The amount of offset will vary depending on the anticipated amount of arrow rotation as the tip pierces the target with existing hunting arrows on offset of between 30 and 50 degrees around the circumference of the ferrule is preferred. Such an offset blade configuration for a rotating arrow is shown in FIG. 8.

To further enhance penetration of the broadhead, the ferrule diminishes in cross section immediately behind the point. The ferrule can also be straight or parallel to the axis. As shown in the preferred embodiment, the ferrule is elongated and substantially cylindrical. Accordingly, a cross section taken perpendicular to the ferrule's axis of elongation will be circular (see, e.g., FIG. 4). The area of this circle, however, varies along the length of the ferrule, and in particular, the ferrule sleeve. At the point, the ferrule has the same cross-sectional area as the rear end of the point. However, from there, the cross-sectional area decreases with distance from the point. This reduces the drag of the ferrule through the target and allows the blades to be more effective. Toward the rear end of the ferrule, the cross-sectional area again increases rapidly to match that of the retaining ring 38 and the arrow shaft. This provides a smooth transition to the arrow shaft so that the arrow, if it has sufficient momentum, can penetrate into the target past the ends of the blades and the end of the ferrule. Such aerodynamic details can also lengthen the arrow's range through the air.

The broadhead arrow penetration can also be affected significantly by the shape of the blades. As best seen in FIG. 2, the cutting edges of the blades extend outward, away from the mounting edge and toward the rear of the ferrule. The cutting edge and the mounting edge are both substantially straight, and preferably form an angle at their junction of 27.5°. If the blade angle is too great, then the broadhead does not penetrate deeply enough into the target. If the blade angle is too little, the blades do not cut the target. With the proper blade angle, maximum penetration and effectiveness is obtained. While exactly 27.5° is not essential, it is preferred that the angle be between 25° and 20°. For the 6.5 cm ferrule discussed above, a blade mounting edge of 3.5 cm including the tab and a blade cutting edge of about 3 cm can form the proper 27.5° angle when the perpendicular support extends perpendicularly from the rear end of the cutting edge to the mounting edge. This is known as the perfect angle of entry.

While only a few embodiments have been discussed above, it will be understood by those skilled in the art that a great variety of modifications and adaptations may be made to those embodiments without departing from the spirit and scope of the present invention. Different materials may be substituted for those which are presently preferred. The number and orientation of blades may be varied to suit particular applications. The blades may be removed entirely, and a different type of point used to suit different types of targets or different bows. It is not intended to limit the scope of the present invention to the embodiments described above, but only by the claims below.

What is claimed is:

1. A broadhead for use with an arrow shaft comprising:

a blade having a substantially straight mounting edge and a cutting edge supported by the mounting edge;

an elongated ferrule for connecting to the arrow shaft having an exterior groove for receiving the mounting edge of the blade, the groove having a bottom floor with a plurality of spaced apart deformable lands; and means for pressing the mounting edges against the lands, deforming the lands to suit the applied pressure and for holding the mounting edges in place.

2. The broadhead of claim 1 wherein the blade cutting edge joins the blade mounting edge at an angle and wherein the means for pressing the mounting edge comprises an inclined surface at one end of the groove, adapted to receive the cutting edge and a retaining ring at the opposite end of the groove for driving the cutting edge toward the inclined surface, the inclined surface driving the mounting edge against the lands as the cutting edge is driven toward the inclined surface.

3. The broadhead of claim 2 comprising a point at the end of the ferrule opposite the shaft connection, the point having an interior rear surface facing the ferrule and wherein the interior surface comprises the inclined surface.

4. The broadhead of claim 2 wherein the ferrule comprises a threaded connector for screwing onto the arrow shaft and the retaining ring is adapted to engage a flange on the arrow shaft so that as the ferrule is screwed onto the arrow shaft, the retaining ring is driven toward the inclined surface, driving the blade toward the inclined surface.

5. The broadhead of claim 4 wherein the deformable lands allow the blades to be rotated into alignment with the arrow shaft nock while maintaining pressure on the mounting edges.

6. The broadhead of claim 4 wherein each blade comprises a tab for extending inside the retaining ring to hold the blades in place in the groove.

7. The broadhead of claim 1 wherein the ferrule comprises a rigid core and a deformable sleeve, the lands being integrally formed with the sleeve.

8. The broadhead of claim 7 wherein the sleeve is formed substantially of a thermoplastic polycarbonate resin.

9. A broadhead for use with an arrow shaft comprising:

a blade having a substantially straight mounting edge and a cutting edge, the cutting edge joining the mounting edge at one end and extending away from the mounting edge toward its other end;

an elongated ferrule having a rear end for connection to the arrow shaft and a front end for supporting a point;

a groove in the ferrule for receiving the mounting edge of the blade, the groove having an inclined surface at one end near the point and extending from the inclined surface toward the ferrule rear end, the groove also having a bottom floor with a plurality of spaced apart deformable lands; and a retaining ring adapted to fit around the ferrule to engage an end of the blade mounting edge opposite the cutting edge joint on one side and the arrow shaft on the other side so that as the ferrule is connected to the arrow shaft the retaining ring is pushed toward the groove inclined surface by the arrow shaft, driving the blade cutting edge toward the inclined surface and thereby driving the blade mounting edge toward the lands, deforming the lands to suit the pressure applied by the mounting edge.

10. The broadhead of claim 9 wherein the ferrule rear end comprises a threaded connection for connecting to the arrow shaft so that as the ferrule is screwed onto the arrow shaft the retaining ring drives the blade mounting edges toward the inclined surface of point.

11. The broadhead of claim 9 wherein the grooves extend from the ferrule front end along a substantially straight line parallel to the ferrule's axis of elongation.

12. The broadhead of claim 9 comprising a point at the ferrule front end having an interior rear surface for connection to the ferrule, the rear surface forming the inclined surface of each groove.

13. The broadhead of claim 9 wherein the deformable lands allow the blades to be rotated into alignment with the arrow shaft nock while maintaining pressure on the mounting edges.

14. The broadhead of claim 9 wherein the ferrule comprises a rigid core and a deformable sleeve, the lands being integrally formed with the sleeve.

15. The broadhead of claim 14 wherein the sleeve is formed substantially of a thermoplastic polycarbonate resin.

16. The broadhead of claim 9 wherein the end of the blade comprises a tab for extending inside and thereby engaging the retaining ring to hold the blades in place in the groove.

* * * * *